United States Patent [19]

Kvamsdal et al.

[11] 3,968,764

[45] July 13, 1976

[54] SHIPS FOR TRANSPORT OF LIQUEFIED GASES

[75] Inventors: Rolf Kvamsdal, Jeloy; Roar Tobiassen, Stavanger, both of Norway

[73] Assignee: Moss Rosenberg Verft A/S, Jeloy, Norway

[22] Filed: Jan. 10, 1975

[21] Appl. No.: 540,095

[30] Foreign Application Priority Data

Oct. 31, 1974 Norway ..... 743932/74

[52] U.S. Cl. ..... 114/74 A; 220/9 LG

[51] Int. Cl.[2] ..... B63B 25/08

[58] Field of Search ..... 114/74 R, 74 T, 74 A, 114/222; 220/9 A, 9 F, 9 LG, 15; 252/70; 51/9 M

[56] References Cited

UNITED STATES PATENTS

| | | | |
|---|---|---|---|
| 2,470,986 | 5/1949 | Jackson | 220/9 A |
| 2,806,810 | 9/1957 | Beckwith | 220/9 LG |
| 3,341,049 | 9/1967 | Forman et al. | 114/74 A |
| 3,502,239 | 3/1970 | Worboys et al. | 114/74 A |
| 3,556,917 | 1/1971 | Eakin et al. | 220/9 F |
| 3,757,982 | 9/1973 | Isenberg et al. | 220/9 LG |
| 3,814,275 | 6/1974 | Lemons | 220/9 LG |
| 3,828,709 | 8/1974 | Bognaes et al. | 114/74 A |
| 3,859,805 | 1/1975 | Johnson et al. | 114/74 A |
| 3,875,886 | 4/1975 | Glasfeld et al. | 114/74 A |

FOREIGN PATENTS OR APPLICATIONS

| | | | |
|---|---|---|---|
| 306,254 | 9/1968 | Sweden | 114/222 |

OTHER PUBLICATIONS

Cowling, J. E. et al.; "Temperature – Indicating Paints," *Industrial and Engineering Chemistry*, Oct. 1953, pp. 2317–2320.

*Primary Examiner*—Trygve M. Blix
*Assistant Examiner*—Jesus D. Sotelo
*Attorney, Agent, or Firm*—Burns, Doane, Swecker & Mathis

[57] ABSTRACT

A ship having large, internally insulated, self-supporting spherical tanks for transport of liquefied gases is described. Different insulation materials are presented. Control systems for the insulation is provided. Also a method for applying the insulation is disclosed.

3 Claims, 5 Drawing Figures

SHIPS FOR TRANSPORT OF LIQUEFIED GASES

The invention relates to ships for transport of liquefied gases. The invention is particularly developed for transport of natural gases in liquefied form, the so-called LNG (liquid natural gas) and are described in connection with such gas transport; however, the invention can of course be used to advantage for transport of other gases, for example, the so-called petroleum gases of LPG (liquid petroleum gas). The major difference between these two types of gases is, in actual fact, only the different temperatures at which they are transported, LPG being transported in liquid form at about −50°C at atmospheric pressure, whilst LNG requires a temperature of −161°C.

Natural gas can, in principle, be transported either in gaseous state or liquid state. In gaseous state, natural gas can advantageously be transported in pipes. The transport of natural gases to remote places is most effectively carried out by reducing the volume of the gas by converting it to liquid state. Such a conversion allows great reduction of storage volume, especially a six hundredth part for a given quantity of, for example, methane gas, and this permits an extremely effective transport of gas to remote locations. Liquefied natural gas, i.e. LNG can, admittedly, theoretically also be transported through pipes; however, no economically justifiable pipe transport system for liquid natural gases has as yet been developed.

In order to transport liquefied gas in a practical and economical manner in relatively large volumes, it is necessary to store the liquefied gas at approximately atmospheric pressure during the transport since, in practice it is difficult, not to say impossible, to construct seagoing tankers with large containers constructed to withstand extremely high interior pressure. However, at atmospheric pressure, liquefied gases have extremely low evaporation temperatures. These can vary from about −260°C for liquefied hydrogen to −33°C for liquefied ammonia. With transport of liquefied natural gases (LNG), which is of great interest at the present time, the evaporation temperature is −161°C. These unusually low temperatures in the liquids cause problems in regard to the design and production of tankers for transport of such liquefied gases. This particularly applies to the cargo hold of the tanker which must be capable of preventing heat loss leading to evaporation of the liquefied gas, and the cargo holds must also be capable of withstanding the interior stresses arising as a result of the great loss of temperature in the walls.

In recent years, a number of different tank systems have been developed for LNG tankers. These tanks systems can be roughly divided into two main types, viz. self-supporting tanks and membrane tanks.

By the term self-supporting tanks, are envisaged tanks which, due to their construction, can receive the weight of the load and their own weight without support or securement of the separate tank walls against or to the actual hull of the ship. The total weight of the tanks with cargo is transferred to the hull of the ship by means of various suspensions which must not prevent, or prevent only to a slight degree, a contraction of the tanks on refrigeration.

Membrane tanks are the type of tanks where the walls are either secured to the actual hull of the ship over the entire surface thereof, or where the walls, by means of an over-pressure in the tanks, are maintained in engagement with the bulkheads of the cargo hold. The weight of the tank and the pressure of the cargo is transferred through the tank wall to a supporting insulation and transmitted thereby to the hull of the ship. The tank walls, which are usually produced from specially shaped, thin, nickel-steel plates, are only to ensure the tightness of the tank and have no stress resistance function.

The invention relates to a further development of tank systems of the self-supporting type and is based on the spherical tank construction which is the most promising at the present time and is described in Norwegian Pat. No. 124,471.

This spherical tank constructon known as the Moss-Rosenberg spherical tank system is based on the so-called "leak before failure" idea, i.e. that, in consequence of the favourable stress resistant properties of the sphere, a crack spreads so slowly that there will be sufficient time from the discovery of the leakage and the occurrence of a critical crack length to reach port and unload the cargo.

Spherical cryogenic tanks which are without reinforcements are produced from 9% Ni-steel or from aluminium. The spheres are mounted in a cylindrical construction, the so-called skirt, which stands upon the double bottom of the ship. The upper part of the skirt is produced from aluminium when the tank is produced from aluminium.

The connection between tank and skirt is carried out by means of a special profile arranged at the equator of the sphere. The connection between the aluminium part of the skirt and the steel part is carried out by means of explosion plated or roller plated steel-aluminium connection profile.

In addition to the external insulation of the sphere, the upper portion of the skirt is also insulated. The insulation is carried out by adhesion of insulation plates or by winding on of insulation elements, with adhesion of insulation plates in areas where winding cannot be undertaken. The selfsupporting insulation may, for additional safety, also be retained by tension bands which extend from the equator area to the two poles. The lower part of the cargo hold is insulated liquidtight (up to about three to four meters above the tank deck), so that a safety trough is formed in case of leakage from the tank.

A decisive advantage of the spherical tank system is that the so-called second barrier, which is normally required in shipboard cryogenic containment systems, can be omitted since the dimensions of the spherical tank can be calculated in a completely satisfactory manner.

Before the tanker can be loaded with the liquefied gas, the tanks must be refrigerated to the cargo temperature. This refrigeration is carried out by spraying LNG through nozzles arranged in the separate tanks. The evaporated LNG is suctioned out and condensed in a suitable apparatus. The refrigeration must not take place too rapidly because of the risk of too great temperature stresses in the tank wall. The refrigeration time is between 30 and 45 hours for aluminium, and 15 hours for 9% nickel-steel. The tanker is then ready for loading.

In addition to the spray system necessary for refrigerating the tanks, a drying equipment is necessary for the spaces around the tanks and an inert gas system for filling the spaces around the tanks with inert gas.

The spherical tank system described hereinabove and further described in Norwegian Pat. No. 124,471, has proved excellent in practice and represents an important advance. In particular, the spherical tank system has allowed at least partial elimination of the so-called second barriers. The spherical tank system is advantageous also in regard to the actual ship construction. A special advantage is that there is relatively great spacing between cargo tanks and the ship side throughout, and this is a great safety measure in the event of collision or grounding.

The object of the invention is to improve the said spherical tank system, and particularly to develop a tank system where the so-called second barriers are entirely eliminated. An important object is also to reduce the constructional and operational costs of tankers of this type. According to the invention, the necessary insulation is disposed internally in the spherical tanks. Internal insulation of smaller containers for storage of cryogenic, liquefied gases is, in fact, previously known but is used for space ships, in other words relatively small containers. Here the requirement is a protection for use, once only, for a relatively short period of time while, for LNG ships, it is necessary that the insulation lasts for special fillings over a long period of time. Furthermore, a proposal is known to spray a foam insulation directly onto a double hull for use in the transport of LPG. In regard to LNG, where it is a question of cryogenic temperatures, the conditions are different, however.

An obvious solution, in regard to reducing the costs of LNG ships, might be to propose an internal insulation of a double hull. Such a solution is proposed by Rockwell International. This embodiment requires no steel work, but merely application of an organic material, usually with wholly or semi-automatic equipment. Two main problems arise here, however, which can be divided into technical problems and constructional problems. The technical problems can again be divided into two. The first of these is that, with insulation applied to a steel material, it will form a cover for possible crack formations so that these are not discovered. At the worst, such undiscovered cracks can develop into critical lengths, with risk of great damage to the entire ship in consequence of fatigue ruptures. It is certainly the case at the present time that much is known about materials and crack formation and it is possible technically to produce constructions which have a satisfactory low crack propagation. It is not considered possible to achieve this with conventional ship's hulls at the present time, however. This is reflected in the fact that low temperature steel is required in internally insulated LPG ships with adjacent hull members.

If a similar fault protection was required with ships intended for transport of LNG, the costs would be prohibitive. Another possible solution would naturally be a warning system which covers the entire hull in the cargo area. Such a warning system cannot be effected today within an economically sound scope, however.

The insulation supporting structure, the inner hull, is directly connected to the outer hull. Damage or impact on the outer hull would be transmitted to the inner hull with very serious consequences, in fact, more serious than would be the case with membrane tanks. In order to achieve the same safety levels as provided by membrane tanks, it would be necessary to provide substantial transverse reinforcements with correspondingly increased costs.

The other main problem is, as mentioned hereinabove, connected with the construction of the ship. To such purpose, an internally insulated double hull is no other than a type of membrane ship, and the fitting time is as much as a year and perhaps more. It is an absolute necessity to finish the hull, at least in the cargo tank area, before it is possible to begin the assembly or production of the tanks. Installation of internal insulation in a double hull with additional warning system of the hull would require at least as much work and time as the installation of a membrane tank system. In addition, with the constantly increasing costs, it would be unjustifiable in a shipbuilding industry to occupy construction docks and fitting quays for a whole year or more in order to complete a single ship.

The possible savings in costs by using internal insulation are much greater in regard to self-supporting tanks. In the first place, there is the possibility of great saving on coversion from cryogenic to non-cryogenic material. Not only is the material used less expensive, but the welding also costs less. The insulation can also be carried out within the finished tank, either onboard or before the finished tank is mounted in the ship. The tank in itself gives a complete protection which is greater than the protection provided at the present time by external insulation.

A substantial advantage of spherical tanks is that they are the only type of tank construction the lifetime of which can be calculated with certainity. A consequence is that spherical tanks do not require a warning system, or that only a greatly reduced warning system is necessary. Spherical tanks are also independent of the hull. No extra reinforcement of the hull is necessary to provide adequate safety.

With respect to operational costs, a ship having large, thermically insulated, self-supporting spherical tanks for transport of liquefied gases with internal insulation of spherical tanks, has the following operational advantages:

The necessary refrigeration (cooling) after docking and the like), and also boil-off during ballast travel is, in practice, eliminated.

The driving equipment for the space around the tanks can be omitted.

Cargo handling and inert gas systems can be simplified.

The elimination of the great metal masses which must be cooled at the present time means elimination of great refrigeration loss. It is possible to carry out a rapid cooling. There is no longer any necessity to maintain the tanks cold during ballast travel. The total loss as a consequence of evaporation for a so-called full trip, that is to say trips with cargo and return in ballast, is halved. The internal insulation steals a part of the tank volume; however, a part of this loss can be recovered in that the thermic contraction in the spherical tanks is substantially eliminated. With a ship having a cargo volume of 125,000 $m^3$ and with internal insulation according to the invention, the reduced boil-off will compensate for the loss in volume, provided that the distance sailed (days at sea) is of a certain minimum length.

The removal of the external insulation also allows an increase in the diameter of the spherical tanks within the same hull dimensions. An increase of the cargo capacity of about 5% is within the possible range. This increase means a decrease of unit costs (per cubic metre) of the ship.

In regard to the constructional costs (costs per cubic meter cargo capacity), regardless of whether cryogenic or non-cryogenic material is transported in the spherical tanks, the following cost-saving advantages are achieved, increased cargo capacity in the same hull (improved volumetric utilization).

Improved conditions for applicaton of insulation.

The spray system in the cargo tanks can be eliminated.

The drying equipment for the space around the tanks can be eliminated.

The inert gas system for the space around the tanks can also be eliminated, which, in turn, means that the conventional storage tanks for liquid nitrogen used at the present time can presumably be entirely eliminated.

Reinforcement for the tank skirt may be simplified, since it is possible to eliminate the relatively great thermic contraction.

Internal insulation means that the so-called "leak before failure" principle can no longer be used. The reason for this is that the internal insulation, as previously stated, will cover any crack formation. For this reason, much greater demands must be made in regard to the internal insulation than to the external. A suitable insulation is, for example, polyurethane foam with high density and strength, optionally with a reinforcement. Another suitable insulation is a polyurethane foam plastic with orthogonal reinforcement of glass fibre. A suitable material of this type is the so-called 3 D-foam which is marketed by McDonnell Douglas Astronautics Co.

The insulation is preferably constructed from insulation plate elements which are adhered to the internal wall of the spherical tank.

When a cryogenic material is used in the spherical tank, the demands on the integrity of the insulation are not so extreme as those necessary when a non-cryogenic material is in a spherical tank. With cryogenic material the actual tank forms a safety system which prevents cold liquid coming into contact with the steel in the hull if the insulation should fail. The consequence of a fault in the insulation would, with non-cryogenic material, be so serious that a warning system for the insulation should preferably be installed, particularly when a non-cryogenic tank material is used. The warning system should have a constant control of the state of the insulation, and give alarm in good time so that the tank can be emptied before a dangerous situation has developed. With spherical tanks, it is presumably sufficient to provide a warning system for the insulation at the equator and at the two poles. The manner in which the actual warning system is to be constructed depends on many factors, and sufficient measures are described in previously known technique in regard to the construction of warning systems that it should be unnecessary to describe them further herein. However, it should be mentioned that semi-conductors, thermo-elements, microphones can be used for recording of changes in the boil-off sounds, visual inspection etc.

A suitable non-cryogenic tank material is, for example, steel of the NV 4-4 type. Such steel has long, critical crack length and has a satisfactorily low crack propagation in the temperature ranges for which the steel is approved.

Inasmuch as the insulation according to the invention is applied internally, the insulation of the tank skirt, necessary at the present time, can be eliminated and this also decreases costs.

An advantage of the invention is the visual control which is possible with use of a boom arrangement mounted centrally in the spherical tank and which allows visual inspection of the entire interior of the spherical tank. At the same time, the exterior of the spherical tank is readily accessible for visual inspection. This obviously increases the total safety for the entire transport system.

The invention is further explained with reference to the drawings, where

Figure 1:
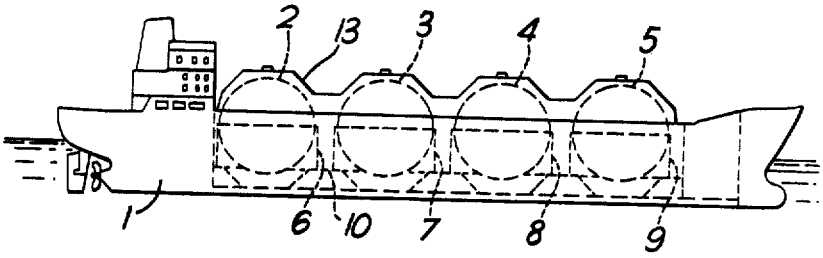
FIG. 1 is a longitudinal view, in diagram, of a ship according to the invention.

The ship illustrated in FIG. 1 has four spherical tanks, 2, 3, 4 and 5, intended for transport of liquefied gases, for example, LPG or LNG. The said spherical tanks are mounted onboard in the ship by means of the respective skirts 6, 7, 8 and 9. The said skirts extend from the equatorial plane of the sphere down to the tank top 10 of the ship. The upper edge of the skirt is welded to an equatorial ring 11 (see FIG. 2) and, at the bottom, is welded to the tank top 10. The skirt is provided with vertical reinforcers 12 to the necessary extent. Each spherical tank is protected above deck by a superstructure.

Figure 2:
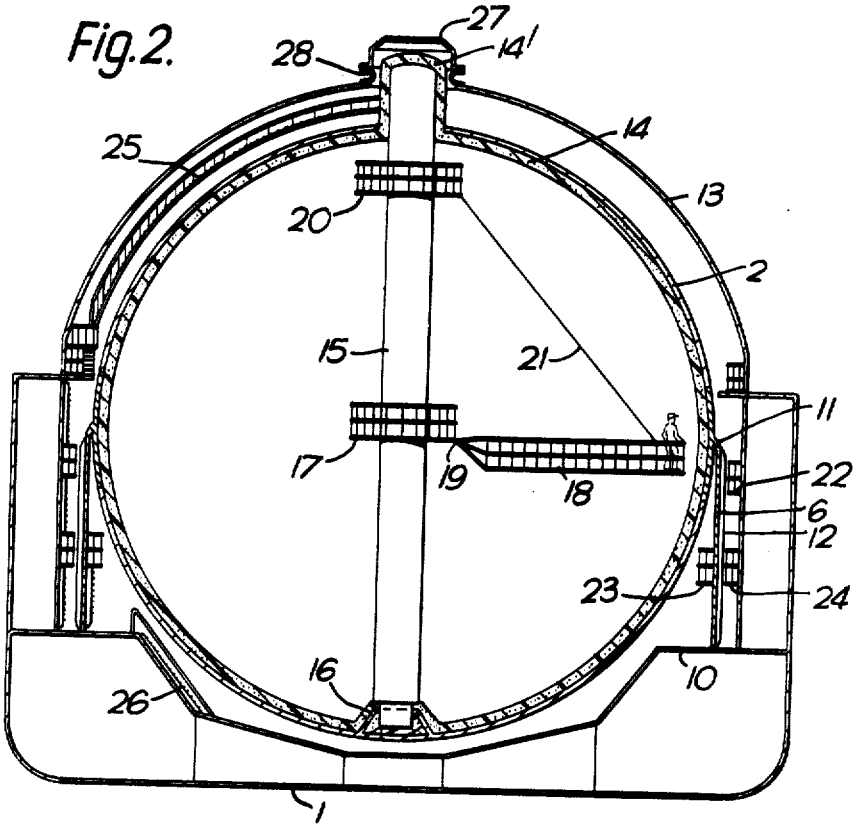
FIG. 2 is a cross-sectional view in diagram through a spherical tank with internal insulation according to the invention.
Figure 3:
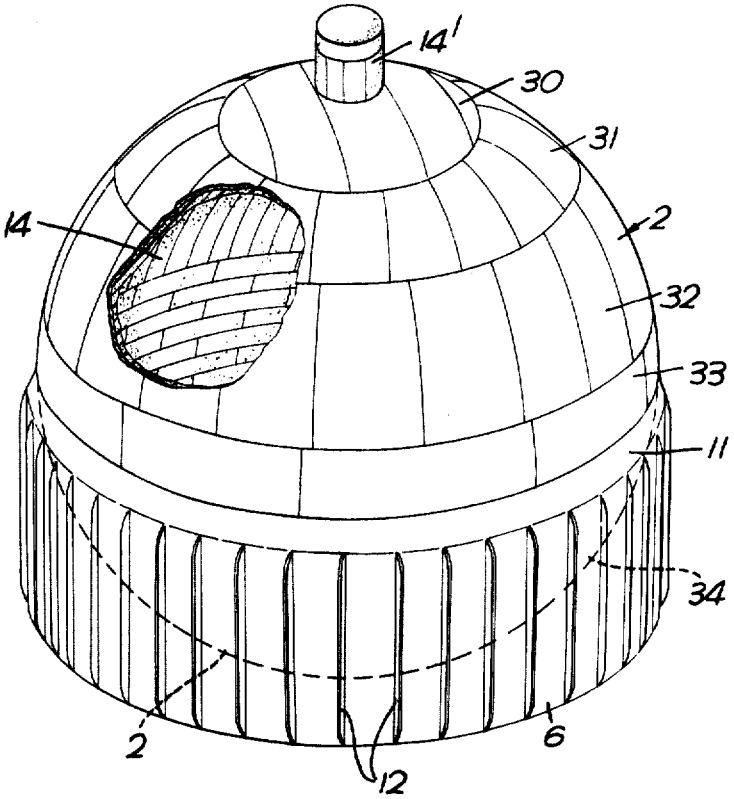
FIG. 3 is a perspective view of a spherical tank with skirt, partially in section, so that it is possible to see a part of the internal insulation.

Each spherical tank 2 – 5 is insulated internally as illustrated in FIGS. 2 and 3, the insulation being indicated by 14. The insulation extends over the entire inner surface of the spherical tank, with the exception of an upper central opening where the control column 15 is passed through the shell of the sphere.

The central column 15 contains the necessary pipes and appurtenant equipment, and rests, in this case, on a cone 16 at the bottom of the spherical tank 2. The insulation is, as illustrated in FIG. 2, carried out on both the outside and inside of the cone 16, and the column or tower 15 rests on the cone via the insulation. Other mounting means are of course possible. The insulation is drawn up around the column 15 so that the column is also insulated.

On a centrally mounted platform 17, a pivotable and movable boom 18 is mounted. In this case, the boom 18 is pivotally mounted at 19 on the platform 17 and the pivotal point can be moved along the circumference of the circular platform 17 illustrated on the drawing. From an upper platform 20, a holding cable 21 for the boom 18 extends. This boom arrangement allows inspection of the interior of the spherical tank.

Cat-walks 22, 23, are arranged for inspection of the exterior of the spherical tank and a gangway 24 is also arranged for external inspection of the skirt. Several ladders 25 are provided for inspection of the upper part of the spherical tank. Via the ladder 25, access is provided to the space beneath the lower part of the sphere. The skirt is provided with an access opening, not further illustrated, so that it is possible to enter into the space between the skirt and the spherical tank for the purpose of inspection.

The cover 13 is substantially spherical in shape. At the top, the super-structure is terminated by a dome 27 mounted on the super-structure 13 by means of a resilient collar 28. The column 15 projects up into the dome 27, and from this space, access is provided to the column 15, with introduction of the necessary pipes, etc., (not shown). As previously stated, the internal insulation 14 of the spherical tank is passed up together with the column 15, and this insulaton is, in FIGS. 2 and 3, indicated by 14'. The spherical tanks, for example, the spherical tank illustrated in FIGS. 2 and 3, which is the rear spherical tank in the ship on FIG. 1, are preferably constructed from previously welded pole caps and annular zones, as illustrated in FIG. 3. The upper pole cap is indicated by 30, an upper annular zone is indicated by 31, and an intermediate zone is indicated by 32. The equator zone with welded-in equator ring 11 is indicated by 33. The construction of the lower half of the sphere 34 is in the same pattern.

On construction of the sphere, it is advantageous to weld the lower pole cap and lower annular zone together and support these temporarily in the correct location onboard. Thereafter, the lower intermediate ring, which is identical to the upper intermediate ring 32, is set in place, supported temporarily and welded. The support is carried out in an adjustable manner, so that it is possible to adjust the height and diameter of the separate annular zones, before the next zone is set in place.

Thereafter, the equator zone is set in place and, after the upper hemi-sphere has been mounted in the same manner, in reverse sequence, and is at least tack-welded, the skirt 6 is constructed and the spherical tank is then finally welded. Steel of the type NV 4-4 is used as material in the embodiment example. This is a non-cryogenic steel which can withstand temperatures to about −30°C.

The same material is preferably used in the skirt 6.

As previously stated, the life-time of a spherical tank can be calculated with a fairly large saftey margin. The calculated life time for the spherical tanks used at the present time is as much as 200 years or more, in other words much more than the normal life time of a ship. However, since it is not possible to use the "leak before failure" principle, great care must be taken with the internal insulation, particularly when a non-cryogenic material is used in the spherical shell. One suitable material is polyurethane foam plastic with orthogonal reinforcement of glass fibre, previously described. In addition to good insulating properties and resistance to the affect of liquid gases, this material has orthogonal glass fibre reinforcements which make it very suitable for use in spherical tanks for transport of liquefied gases. In addition to the load exerted by the liquid cargo, there is also the loads resulting from the passage of the ship through the sea and these are factors which must be taken into consideration when determining the insulation material to be used within the spherical tank.

Mounting of the insulation can be carried out in many different ways, for example, in accordance with the "orange peel" method.

Another method is to use triangular plate elements which are glued to the inside of the spherical shell. In FIG. 3, a third possibility is illustrated where plate or rod-shaped insulation elements are used which are applied in part in parallel with the equator and in part in the meridian direction. Other application patterns can of course be used. The insulation can also be sprayed on directly. The method of insulating and the insulating material are dependent on the demands made to the insulation at all times. It is not necessary to use an insulation of which the surface is liquid-tight. A better criterion is that the insulation shall have only a limited absorption capability with respect to the specific cargo to be transported by the spherical tank, and that said insulation is capable of regenerating the gas when such conditions arise, i.e. when the temperature rises and the pressure decreases. Other criteria in the selection of insulation material are, as stated, the necessary mechanical strength, and both material and adhesive must be able to withstand the thermic tensions arising as a result of the great thermic contraction. It may also be desirable that the insulation material used have flame-inhibiting properties. Polyurethane foam, mentioned previously as suitable material, is known to be somewhat inflammable, particularly when new; however, with use of cut plate elements, no substantial risk is present, in contrast to, for example, sprayed or foamed material produced in situ. The shape of the spherical tank ensures good ventilation and even if the insulation material generates hydrocarbon vapours for some time after the emptying of the spherical tank, the shape of the spherical tank will, notwithstanding, ensure so effective a ventilation that the spherical tank can be entered by human beings after a couple of hours.

Figure 4:
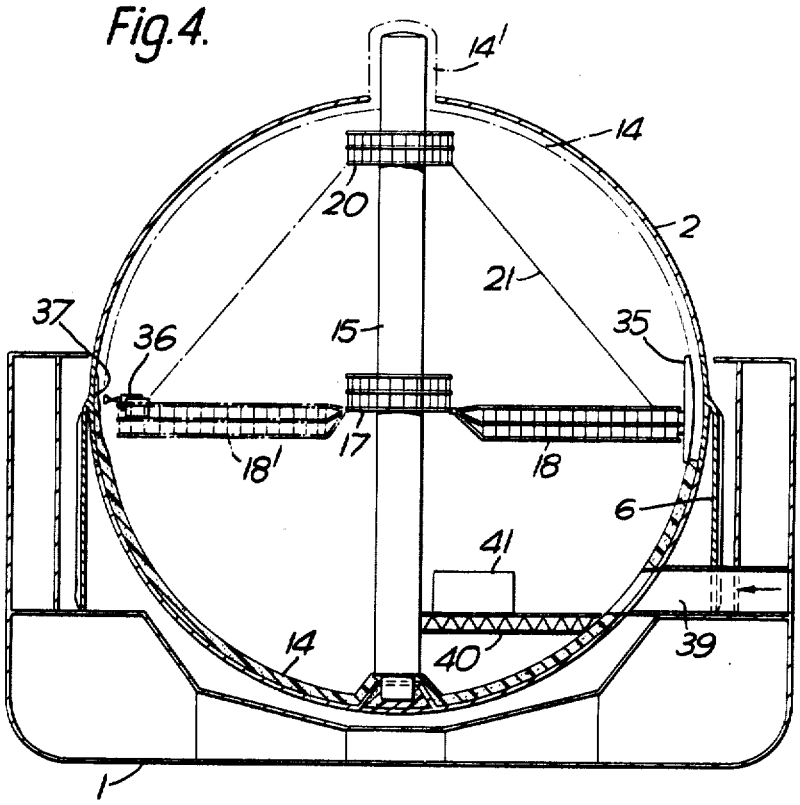
FIG. 4 is a cross-sectional view in diagram through a spherical tank as in FIG. 2, with possible utilization of boom constructions.

FIG. 4 is a diagrammatic section as in FIG. 2, through the same tank, during construction of the insulation. Further specified, the Figure shows how a boom construction 18 can be used in the production of the internal insulation.

The boom 18 supports a mould plate 35 which, together with the spherical shell 2 forms a mould for moulding insulation in situ. The upper half part of the sphere shows the insulation finished almost up to the equator. Further, an inlet opening 39 is illustrated which is kept free during insulation, and a platform 40 is indicated for arrangement of necessary machinery 41 used during application of the insulation. This can be a question of mixing machines for the plastic components and other equipment, and also storage place for finished, for example, plate-shaped, insulation elements which are then set in place by means of the boom construction 18, and necessary scaffolding which can be constructed from the bottom of the spherical container, or suspended in the boom 18. The scaffolding, etc., is not illustrated since it is considered unnecessary to the understanding of the invention. The mould plate 35, can, for example, be replaced by a construction which can exert a necessary pressure on the plate elements during the setting time of the adhesive.

In the spherical tank 2 shown on the left-hand side in FIG. 4, a boom 18' is indicated. This is the same boom as the boom 18, with the difference that a spray machine 36, which sprays on the necessary insulation 37, is shown here instead of the mould plate 35.

Other ways of applying the insulation can of course be envisaged and the examples indicated in diagram here serve merely to elucidate the existing possibilities.

Figure 5:
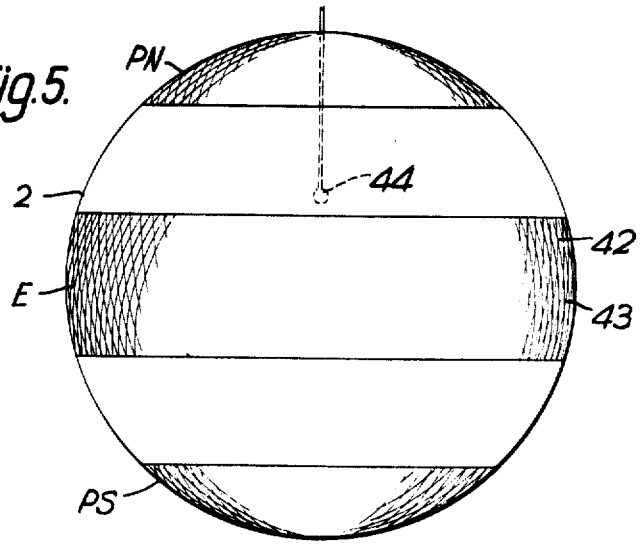
FIG. 5 is a view, in diagram only, of how a spherical tank can be controlled.

FIG. 5 shows in diagram a possible control system for the spherical tank 2. The north pole cap PN, the equator zone E and the south pole cap PS are, in FIG. 5, provided with thermo-elements 42, 43 which are arranged in coordinate pattern. In this manner, it is possible, by recording the activation of the thermo elements not only to establish whether a fault exists or the possibility of a fault, but also to determine where the fault or fault possibility is. The thermo elements are laid on the actual spherical shell.

FIG. 5 also shows the arrangement of a microphone 44 within the spherical tank. This microphone can, for example, receive amendments in the boiling noise, so that it is possible to draw conclusions in regard to the operation condition. The disposition of the microphone 44 in FIG. 5 is of course merely diagrammatic.

Many other control systems exist and these are not discussed further here, since all belong to the prior art. Inter alia, it is possible to use colour changing, i.e. colour coating which changes colour when the temperature changes, so that faults or fault possibilities are discovered by visual inspection of the spherical tank.

By means of the invention, a ship is provided which, in this satisfactory manner — both in regard to risk and economy — can be used for transport of liquefied gases, particularly LNG. The equipment necessary for loading and unloading, and maintenance of the temperature is not described, since these pertain to the known technique. A skilled person will be able immediately to decide on the necessary equipment from the existing literature.

In addition to the achievement of a very secure ship, which per se is the most essential feature, economic advantages are also achieved both in regard to operation and construction of the ship. Whether cryogenic tanks or non-cryogenic tanks are constructed, remarkable operational advantages are obtained. In the first place, these are the elimination of the otherwise necessary refrigeration (after docking and the like) and, in practice, and elimination of boiling-off during ballast trips. The drying equipment in the spaces around the tanks is no longer needed, and the loading equipment and inert gas systems can be simplified.

The elimination of great metal masses which must be refrigerated, also causes an elimination of the otherwise usual, great refrigeration loss. It is possible to undertake a rapid refrigeration. There is no longer any need to maintain the tanks cold during ballast trips. The total loss in consequence of evaporation during the entire trip (cargo trip and ballast trip) is halved.

In regard to the constructional costs, increased cargo capacity is obtained with the same hull dimensions, improved conditions in regard to application of the insulation are obtained, the spray system necessary today for cargo tanks can be removed, drying equipment for the spaces around the tanks can be eliminated. The nitrogen system conventional at the present time for the spaces around the tanks can also be removed, and this again means that it is presumably possible to omit the tank for storage of liquid nitrogen. The reinforcing system of the tank skirt can be simplified, inasmuch as the relatively great thermic contractions have been eliminated.

Having described our invention, we claim:

1. In a marine vessel for the transport of liquefied gas, a hull, a plurality of spherical tanks of non-cryogenic material for storage of said liquefied gas, a cylindrical skirt extending from the hull of the vessel up to the equator of each tank and secured to the tank at the equator to support the tank, a layer of thermally insulating material secured over the inner surface of the wall of each tank, the outer surface of the wall of each tank being accessible for inspection for faults;

scaffolding means provided at the interior and the exterior of each of said tanks to facilitate inspection of the interior insulating material and of the exterior of said tank wall, respectively;

each of said tanks further comprising:

a central column for enclosing piping extending into said tank through an opening in the top thereof and supporting said scaffolding means in the tank, a truncated substantially conical member secured at its base to the bottom of the tank and extending upwardly therefrom to support said central column at its lower end in spaced relation to said bottom of the tank, thermally insulating material disposed on the inner and outer surfaces of said substantially conical member and in said member between the lower end of the column and the tank, and thermally insulating material on the upper portion of the column extending through the opening in the tank.

2. A marine vessel as defined in claim 1, wherein each tank has a self-supporting, single-shelled wall.

3. A marine vessel as defined in claim 1, wherein said scaffolding means in said tank comprises a boom member pivotably supported from said central column.

* * * * *